US006454263B1

(12) United States Patent
Bandieri

(10) Patent No.: US 6,454,263 B1
(45) Date of Patent: Sep. 24, 2002

(54) NUTRITION BOARD GAME

(76) Inventor: A. Louise Bandieri, 4 Brichwood Rd., Bristol, RI (US) 02809

( * ) Notice: Subject to any disclaimer, the term of this patent is extended or adjusted under 35 U.S.C. 154(b) by 0 days.

(21) Appl. No.: 09/668,808

(22) Filed: Sep. 22, 2000

(51) Int. Cl.[7] ..... A63F 3/00
(52) U.S. Cl. ..... 273/243; 273/292; 273/249
(58) Field of Search ..... 273/236, 242, 273/243, 246, 248, 249, 292

(56) References Cited

U.S. PATENT DOCUMENTS 4,273,337 A * 6/1981 Carrera
4,398,721 A * 8/1983 McKay ..... 273/249
4,575,095 A * 3/1986 Gaster
5,190,292 A * 3/1993 Perry
5,478,086 A * 12/1995 Aylett
5,544,891 A * 8/1996 Gibson
5,683,251 A * 11/1997 Logan et al. ..... 273/156
5,799,942 A * 9/1998 Birt

* cited by examiner

*Primary Examiner*—Benjamin H. Layno
*Assistant Examiner*—V K Mendiratta
(74) *Attorney, Agent, or Firm*—Cristina M Offenberg

(57) ABSTRACT

A nutrition board game is disclosed which has a game board, movable pieces, food group cards, a menu card, and a spinner for simulating a healthful eating diet. The board piece is marked to follow a path with the movable pieces based on the roll of a die.

7 Claims, 3 Drawing Sheets

MENU / CARTA

BREAKFAST/DESAYUNO

MILK GROUP
Derivados De La Leche _____

FRUIT GROUP
Derivados De Las Frutas _____

MEAT GROUP
Derivados De La Proteina _____

GRAIN GROUP
Derivados De Los Granos _____

LUNCH/ALMUERZO

MILK GROUP
Derivados De La Leche _____

FRUIT GROUP
Derivados De Las Frutas _____

MEAT GROUP
Derivados De La Proteina _____

VEGETABLE GROUP
Derivados De Los Vegetables _____

GRAIN GROUP
Derivados De Los Granos _____

DINNER/CENA

MILK GROUP
Derivados De La Leche _____

FRUIT GROUP
Derivados De Las Frutas _____

MEAT GROUP
Derivados De La Proteina _____

VEGETABLE GROUP
Derivados De Los Vegetables _____

GRAIN GROUP
Derivados De Los Granos _____

MENU / CARTA

BREAKFAST/DESAYUNO

MILK GROUP
Derivados De La Leche _____

FRUIT GROUP
Derivados De Las Frutas _____

MEAT GROUP
Derivados De La Proteina _____

GRAIN GROUP
Derivados De Los Granos _____

LUNCH/ALMUERZO

MILK GROUP
Derivados De La Leche _____

FRUIT GROUP
Derivados De Las Frutas _____

MEAT GROUP
Derivados De La Proteina _____

VEGETABLE GROUP
Derivados De Los Vegetables _____

GRAIN GROUP
Derivados De Los Granos _____

DINNER/CENA

MILK GROUP
Derivados De La Leche _____

FRUIT GROUP
Derivados De Las Frutas _____

MEAT GROUP
Derivados De La Proteina _____

VEGETABLE GROUP
Derivados De Los Vegetables _____

GRAIN GROUP
Derivados De Los Granos _____

FIG 7.

NUTRITION BOARD GAME

FIELD OF THE INVENTION

The present invention relates to the art of board games for multiple players and, more particularly, to a board game which teaches a basic understanding of the fundamentals of eating a healthful balanced meal based on the foundations of the food pyramid.

BACKGROUND

It is common knowledge among nutritionists and teachers that there are five basic food groups. In order to balance a daily diet one must eat food from each of the five food groups. This game deals with the minimum daily requirements according to the USDA guidelines for a balanced meal which are: one food from the milk group, one food from the protein group, one food from the fruit group and two foods from the grain and vegetable groups. Devices such as charts, books, and pyramid diagrams exist which are used to teach children and adults the suggested minimum and maximum food requirements for a balanced daily diet. However, some individuals and, specifically, children do not have the attention span or desire to learn these principles from the existing medium. Thus, it is readily apparent that it would be highly desirable to provide a means by which the principles of eating a well-balanced diet can be taught and reinforced in a multifaceted, highly compressed time frame and in a manner which is both educational and entertaining. This game provides a way to learn, reinforce and apply the knowledge imparted in both the English and Spanish languages.

SUMMARY OF THE INVENTION

The present invention provides a board game which is specifically adapted for multiple players. A purpose of the game is to teach the fundamental aspects of nutrition. The present invention is an improvement over existing devices and charts. It provides a board game particularly adapted for multiple players that teaches the fundamental aspects of nutrition in both the English and Spanish languages. The cards, menus and spinners are printed in both the English and Spanish languages thus simultaneously exposing the players to both languages. Another aspect unique to this game is the use of a menu as its paradigm. The players use their menu to record the food that is named on the card he/she has drawn during play.

The board game provided introduces several elements of chance, which include wild spaces, take a spin spaces, and the ability of a player to advance along the game board from a start point to a finish along a variety of paths. Yet another object of the present invention is to provide a game which teaches the prevailing nutritional fundamentals in a compressed time frame by using a means which is entertaining to the players. It is a further object of this invention to provide such a game in which the lessons resulting from play are essentially self- taught and do not require the intervention of an instructor. Those skilled in the art will recognize that a unique, multifaceted bilingual type of board game has been developed in this invention. It includes several elements of gaming together with educational and entertainment aspects which, in combination, have heretofore been unappreciated. Moreover, those skilled in the art will also recognize the above-mentioned features and advantages of the board game together with other aspects thereof upon reading the detailed description and the claims which follow in conjunction with the drawings.

Unique Aspect

The salient points of the game are:

1. The use of a menu as a paradigm for recording a player's progress along a travel path.
2. Two hundred fifty food group cards which identify a large variety of foods from each food group.
3. Providing a visual association between exercise, physical activity and good health through the graphics on the box, game board and "wild" cards.
4. Through the enjoyment of play the player is exposed to a healthful diet and the respective food groups that comprise such a diet.
5. The gameboard paths provide freedom of choice and the element of chance to travel in any direction back and forth along the travel path.
6. Spinners printed in both the English and Spanish languages provide an opportunity for a player to acquire more than one food on a turn.
7. Game cards with specific drawings introduce players to foods that they might not otherwise become familiar with.
8. The educational value is multifaceted because a player's chance to win necessitates reading, writing, speaking, visualizing, thinking, associating, and exposing the mind to both the English and Spanish languages.
9. Each player's "turn" and every game is different as the menu card is completed based on chance by a roll of the die, the wild spaces and the spinner.

BRIEF DESCRIPTION OF THE DRAWING

FIG. 7 is a view of the menu card used by each player in keeping track of a player's performance in playing the game.

DETAILED DESCRIPTION OF A PREFERRED EMBODIMENT

Figure 1:
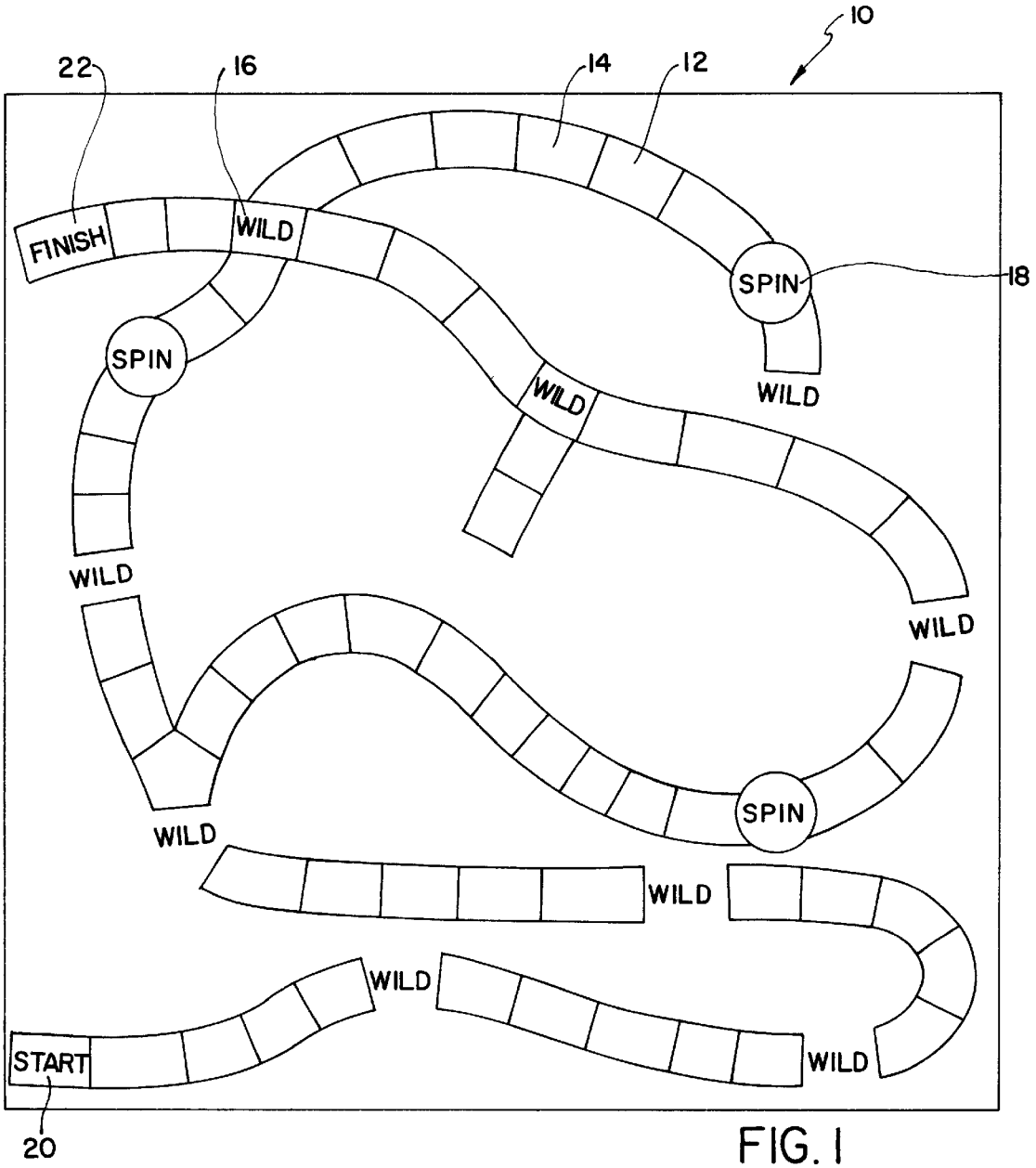
FIG. 1 is a generalized view of a game board for playing the subject game.
Figure 2:
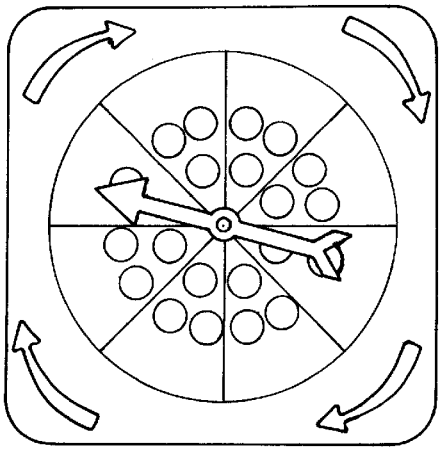
FIG. 2 is a perspective view of the spinner used in playing the game when a player lands on a spin space on the game board.
Figure 3:
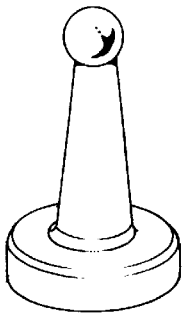
FIG. 3 is a representative game piece used to move on the game board
Figure 4:
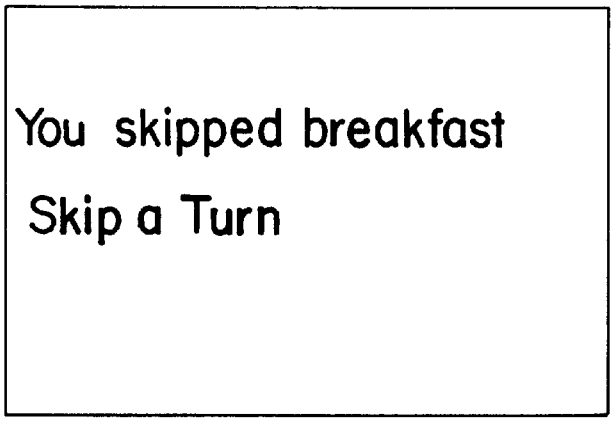
FIG. 4 is an illustration of an exemplary wild card showing an advantageous wild card.
Figure 5:
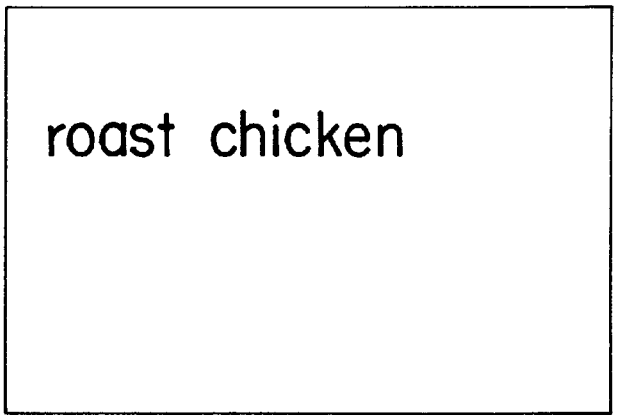
FIG. 5 is an illustration of an exemplary selection of the food group cards showing a vegetable group, grain group, fruit group, protein group, and dairy group.
Figure 6:
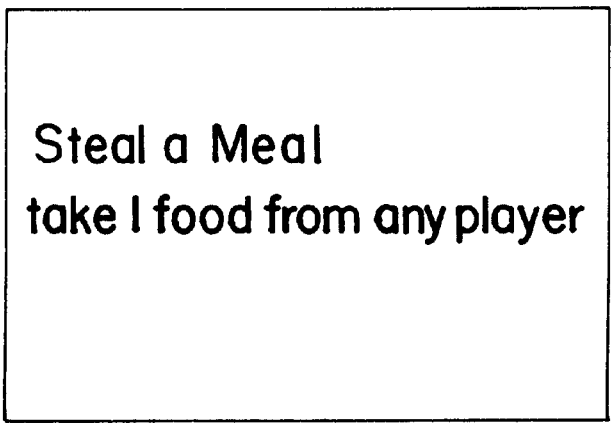
FIG. 6 is an illustration of an exemplary "Steal a Meal" card

Attention is first directed to FIG. 1 which is a generalized representation of a game board (10) for playing the subject game. The game board (10) indicates various paths (12) made of a plurality of connected colored spaces (14) to go from the "start" space (20) to "finish" space (22). FIG. 7 shows the menu card which indicates each food group needed for each meal—breakfast, lunch, and dinner and is the tracking paradigm for a player's performance. Movable game pieces shown in FIG. 3 are used to follow the player's course on the plurality of connected colored spaces (14). The food group cards of FIG. 5 are color coordinated to the plurality of connected colored squares (14) and are indicative of five basic food groups: green is the Vegetable Group, yellow is the Grain Group; pink is the Fruit Group; red is the Meat Group; and blue is the Milk Group. FIG. 4 illustrates the wild cards which are white and correspond with the "wild spaces" (16) on the game board (10). A single standard die not shown is used to count spaces of play. FIG. 2 shows the spinner (there are two included printed in both English and Spanish ) which is used when a player lands on a "spin" (18) space or draws the wild card "Take a Spin" from wild spaces on the game board (10). The various players take turns rolling a die to see how many spaces on the path they should move between 1 and 6. When the player moves, either forward or backward, the player lands on a colored space (14) which indicates the color of the food group card the player should pick. The cards are color coded based on food groups: pink being the Fruit Group, green being the Vegetable Group, red being the Meat Group, yellow being the Grain Group, and blue being the Milk Group. The object of the game is to begin at the "start" space (20) and be the first player to reach the "finish" space (22) after gathering a full balanced diet on the Menu card for each meal (breakfast, lunch, and dinner). If a player does not have a full balanced diet on the Menu card then his play must continue along the various paths (12) on the game board (10). A player can move both forward and backwards on the various paths (12). There are spaces which are marked "wild" and the player picks a corresponding white "wild" card and follows the directions on the wild card. There are spaces which are marked "spin" (18) and the player who lands on it would then spin the spinner which has full meals with different food groups. The player may enter all the food groups represented in the meal onto the menu card. The first player to complete the Menu card and reach the finish space is the winner and the game is over or the remaining players can play until all players have reached the finish space (22).

What is claimed is:

1. An educational board game for teaching nutrition to players comprising a game apparatus including:

a game board including a playing surface formed thereon, said playing surface including a variety of travel paths for one or more play pieces, said travel paths being divided into a plurality of spaces arranged seriatim between a start space and a finish space along said travel paths;

a plurality of game play pieces, each play piece being adapted to be placed on a space on said travel path;

a die;

a plurality of food group cards corresponding to the spaces on the travel path, a spinner compromised of an arrow attached to a flat surface which is divided into pie shaped wedges indicating meals of different food groups labeled on each pie shape;

a plurality of menu cards for each player to list the food groups accumulated by traveling on the travel paths.

2. The game of claim 1 further comprising the menu card indicating the necessary food groups for each of three meals: breakfast, lunch and dinner.

3. The game of claim 1 wherein words on the game board, food group cards and spinner are printed in both the English and Spanish languages.

4. The game of claim 1 further comprising 250 color coded cards coordinated to match the spaces on the travel path and also representing food groups needed for a balanced menu including 42 of each color and 42 "d" cards to match the "wild" spaces on the game board.

5. A game of claim 1 wherein the playing surface of the board game illustrates activities associated with a healthful lifestyle.

6. A game of claim 1 further comprising wild cards which have special instructions for play.

7. Wild cards as claimed in claim 6 further comprising illustrations associated with a healthful lifestyle.

* * * * *